US008821190B2

(12) United States Patent
Matsumura et al.

(10) Patent No.: US 8,821,190 B2
(45) Date of Patent: Sep. 2, 2014

(54) FUSE UNIT

(71) Applicant: Yazaki Corporation, Tokyo (JP)

(72) Inventors: Norio Matsumura, Makinohara (JP); Hidenori Kibushi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/645,667

(22) Filed: Oct. 5, 2012

(65) Prior Publication Data

US 2013/0095696 A1 Apr. 18, 2013

Related U.S. Application Data

(63) Continuation of application No. PCT/JP2011/059125, filed on Apr. 6, 2011.

(30) Foreign Application Priority Data

Apr. 6, 2010 (JP) ..... 2010-087700
Feb. 23, 2011 (JP) ..... 2011-036989

(51) Int. Cl.
*H01R 33/945* (2006.01)

(52) U.S. Cl.
USPC ..... 439/620.27; 439/754; 337/186

(58) Field of Classification Search
USPC ..... 439/620.26–620.27, 763, 754; 337/186, 337/187
See application file for complete search history.

(56) References Cited

U.S. PATENT DOCUMENTS

| | | | | |
|---|---|---|---|---|
| 6,509,824 | B2 * | 1/2003 | Inaba et al. | 337/295 |
| 6,576,838 | B2 * | 6/2003 | Matsumura | 174/66 |
| 6,806,421 | B2 * | 10/2004 | Matsumura | 174/50 |
| 7,663,465 | B2 * | 2/2010 | Matsumoto et al. | 337/187 |
| 7,663,466 | B1 * | 2/2010 | Jetton | 337/191 |
| 2002/0163416 | A1 | 11/2002 | Matsumura | |

FOREIGN PATENT DOCUMENTS

| | | | |
|---|---|---|---|
| EP | 0 884 750 | A2 | 12/1998 |
| EP | 1 255 271 | A2 | 11/2002 |
| EP | 1 498 927 | A1 | 1/2005 |
| JP | 2002-329457 | A | 11/2002 |
| WO | 2008/025792 | A1 | 3/2008 |

OTHER PUBLICATIONS

International Search Report (PCT/ISA/210), dated Jul. 13, 2011, issued by the International Searching Authority in counterpart International Application No. PCT/JP2011/059125.
Written Opinion (PCT/ISA/237) of the International Searching Authority, issued on Jul. 13, 2011 in counterpart International Application No. PCT/JP2011/059125.
Office Action dated Mar. 31, 2014 issued by the Korean Intellectual Property Office in counterpart Korean Patent Application No. 10-2012-7026114.
Chinese Office Action dated May 27, 2014 in corresponding Chinese Application No. 201180017915.8.

* cited by examiner

*Primary Examiner* — Hien Vu
(74) *Attorney, Agent, or Firm* — Sughrue Mion, PLLC

(57) ABSTRACT

A fuse unit includes a first connection part to which power is fed and a second connection part to be connected with a mating terminal. The second connection part includes a bolt connection portion to which the mating terminal is connected by a bolt and a connecter connection portion to which the mating terminal is connected by a connector.

6 Claims, 10 Drawing Sheets

FUSE UNIT

TECHNICAL FIELD

The present invention is related to a fuse unit.

BACKGROUND ART

A conventional fuse unit is disclosed in PTL 1. The conventional fuse unit 100 is fixed to a battery post 102 of a battery 101 via a battery connecting terminal 103 as shown in FIG. 9. The conventional fuse unit 100 includes a busbar 110 which is a conductive metal plate, and an insulating resin part 120 provided on an outer surface of the busbar 110 by insert molding as shown in FIGS. 9 and 10.

The battery connecting terminal 103 is connected to the busbar 110. The busbar 110 has a connection part 111 for power feeding for being fed from the battery post 102, a connection part 112 for starter motor to which a starter motor terminal 130 is connected, a connection part 113 for alternator to which an alternator terminal 131 is connected, plural connection parts 114 for load to which load side terminals (not shown) are connected, a fusible part 115 for alternator interposed between the connection part 111 for power feeding and the connection part 113 for alternator, and plural fusible parts 116 for load respectively interposed between the connection part 111 for power feeding and each of the plural connection parts 114 for load.

An outer periphery of the busbar 110 excluding places of these connection parts 111 to 114 or the fusible parts 115, 116 is covered with the insulating resin part 120. Also, a connector housing part 120*a* by which an outer periphery of the plural connection parts 114 for load is surrounded is formed by the insulating resin part 120.

The other terminal (not shown) is connected to the plural connection part 114 for load by connector connection.

CITATION LIST

Patent Literature

[PTL 1] JP-A-2002-329457

SUMMARY OF INVENTION

Technical Problem

In the conventional fuse unit 100, the other terminal cannot be connected to the connection part 114 for load by bolting connection.

In order to use the connection part 114 for load as the bolting connection, it is necessary to change forms of the busbar 110 and the insulating resin part 120 and it is necessary to newly design a metallic mold of the busbar 110 and a metallic mold of insert molding. Therefore, in order to meet user's needs for both of the bolting connection and the connector connection, it is necessary to prepare plural types of fuse units and there is a problem of increasing the total cost.

It is therefore one advantageous aspect of the present invention to provide a fuse unit capable of accommodating to both of the bolting connection and the connector connection at low cost.

Solution to Problem

According to one aspect of the invention, there is provided a fuse unit, comprising:

a first connection part to which power is fed; and a second connection part configured to be connected with a mating terminal, the second connection part including:

a bolt connection portion to which the mating terminal is connected by a bolt; and a connecter connection portion to which the mating terminal is connected by a connector.

The fuse unit may be configured such that the bolt connection portion and the connector connection portion are provided in a busbar, an insulating resin part is provided around the busbar, the bolt connection portion is formed with a bolt insertion hole, a stud bolt which is inserted into the bolt insertion hole is fixed by the insulating resin part, the connector connection portion is a tab terminal formed by a part of the busbar, and a connector housing is formed at periphery of the tab terminal by the insulating resin part.

A screw of the stud bolt may project at a side which the connector housing projects with respect to the connector connection portion, or project at a side opposite to a side which the connector housing projects with respect to the connector connection portion.

The fuse unit may be configured such that the bolt connection portion and the connector connection portion are provided in a busbar, an insulating resin part is provided around the busbar, the bolt connection portion is formed with a bolt insertion hole, the connector connection portion is a tab terminal formed by a part of the busbar, and a connector housing is formed at periphery of the tab terminal by the insulating resin part.

Advantageous Effects of Invention

According to the invention, the fuse unit can accommodate to both of the bolting connection and the connector connection. Further, one type of fuse unit will suffice, so that the total cost can be reduced.

DESCRIPTION OF EMBODIMENTS

Embodiments of the present invention will hereinafter be described based on the drawings.

FIGS. 1 to 4 show a first embodiment of the present invention.

Figure 1:
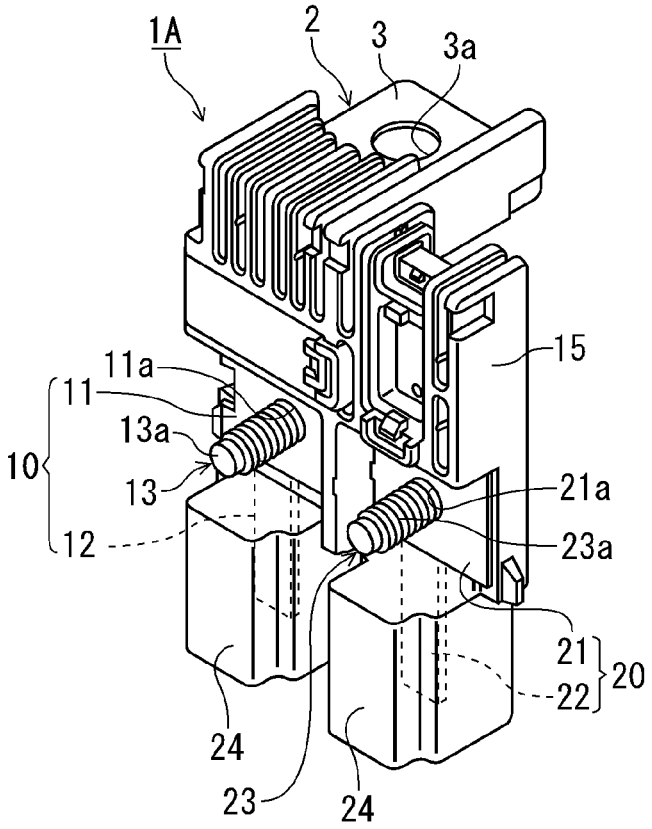
FIG. 1 is a perspective view of a fuse unit according to a first embodiment of the present invention.
Figure 2:
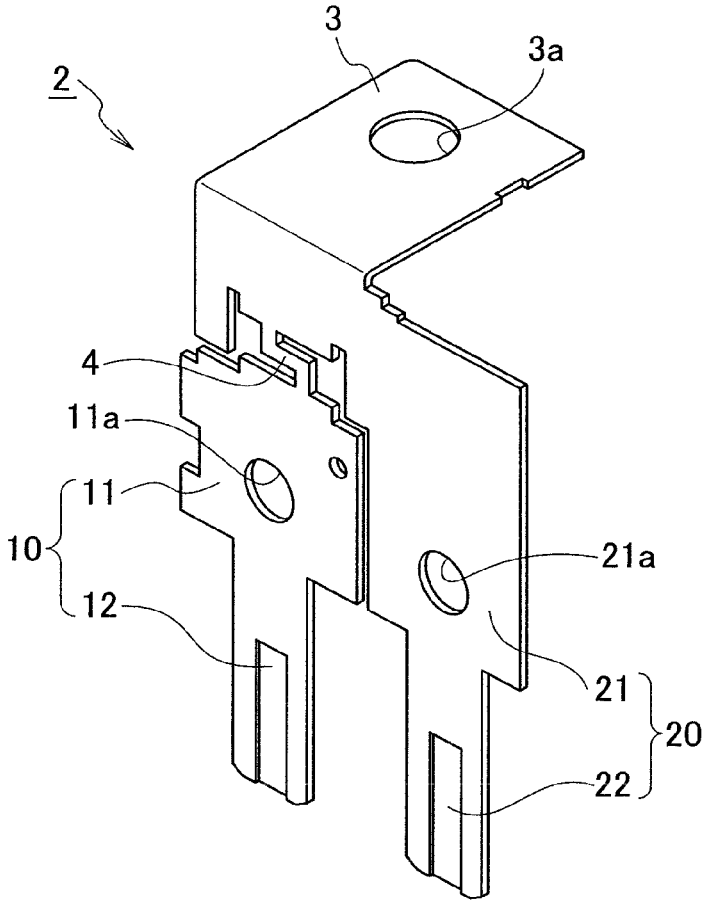
FIG. 2 is a perspective view of a busbar of the first embodiment.

As shown in FIGS. 1 and 2, a fuse unit 1A is fixed to a battery post (not shown) of a battery (not shown) via a battery connecting terminal (not shown). The fuse unit 1A includes a busbar 2 which is a conductive metal plate, and an insulating resin part 15 provided on an outer surface of the busbar 2 by insert molding.

The busbar 2 includes a power-feeding connection part 3 (a first connection part), two terminal connection parts 10, 20 (a second connection part), and a fusible part 4. The power-feeding connection part 3 is connected to the battery connecting terminal for being fed from the battery post. The terminal connection parts 10, 20 are connected to load side other terminals, for example. The fusible part 4 is interposed between the power-feeding connection part 3 and the terminal connection part 10. A bolt insertion hole 3*a* is formed in the power-feeding connection part 3.

Each of the terminal connection parts 10, 20 respectively has bolt connection portions 11, 21 and connector connection portions 12, 22 arranged in sides opposite to the bolt connection portions 11, 21 in the power-feeding connection part 3. The other terminals 30 (shown in FIG. 3) are connected to the bolt connection portions 11, 21 by bolts. The other terminals 31 (shown in FIG. 4) are connected to the connector connection portions 12, 22 by connectors.

Bolt insertion holes 11*a*, 21*a* are formed in each of the bolt connection portions 11, 21. Stud bolts 13, 23 are inserted into the bolt insertion holes 11*a*, 21*a*. Heads (not shown) of the inserted stud bolts 13, 23 are fixed by the insulating resin part 15. Each of the screw parts 13*a*, 23*a* of the stud bolts 13, 23 projects to the same side as a side to which a connector housing part 24 projects with respect to the connector connection portions 12, 22.

Each of the connector connection portions 12, 22 is a tab terminal formed by a part of the busbar 2.

The insulating resin part 15 is arranged so as to cover an outer periphery of the busbar 2 excluding the power-feeding connection part 3, the two bolt connection portions 11, 21 and the fusible part 4. Also, the connector housing parts 24 by which an outer periphery of each of the connector connection portions 12, 22 is surrounded are respectively formed by the insulating resin part 15. That is, the connector housing parts 24 are formed at periphery of the tab terminal by the insulating resin part 15.

Next, an outline of a procedure for manufacturing the fuse unit 1A will be described. First, the busbar 2 shown in FIG. 2 is made by a metallic mold (not shown) of the busbar 2. Next, the busbar 2 in which the stud bolts 13, 23 are inserted into each of the bolt insertion holes 11*a*, 21*a* is set in a metallic mold (not shown) of insert molding, and insert molding of a synthetic resin material is performed. By this insert molding, the insulating resin part 15 is formed on a predetermined outer surface of the busbar 2. At least the head of each of the stud bolts 13, 23 is buried in the insulating resin part 15 so that the stud bolts 13, 23 are fixed.

Figure 3:
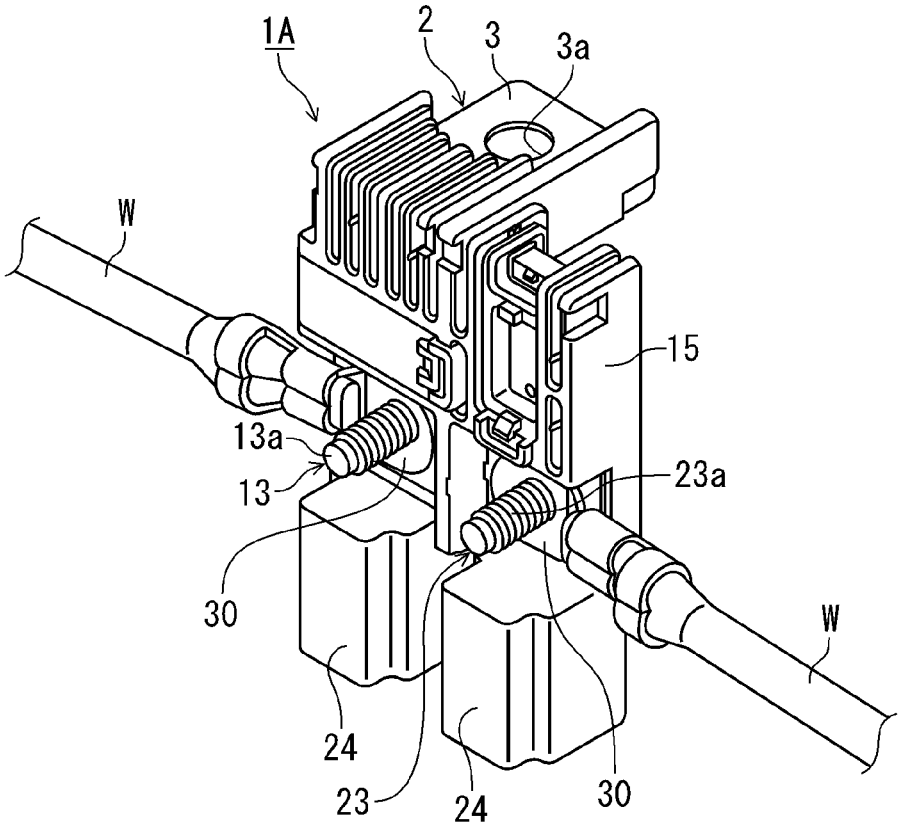
FIG. 3 is a perspective view of the fuse unit to which the other terminal is connected by bolting.
Figure 4:
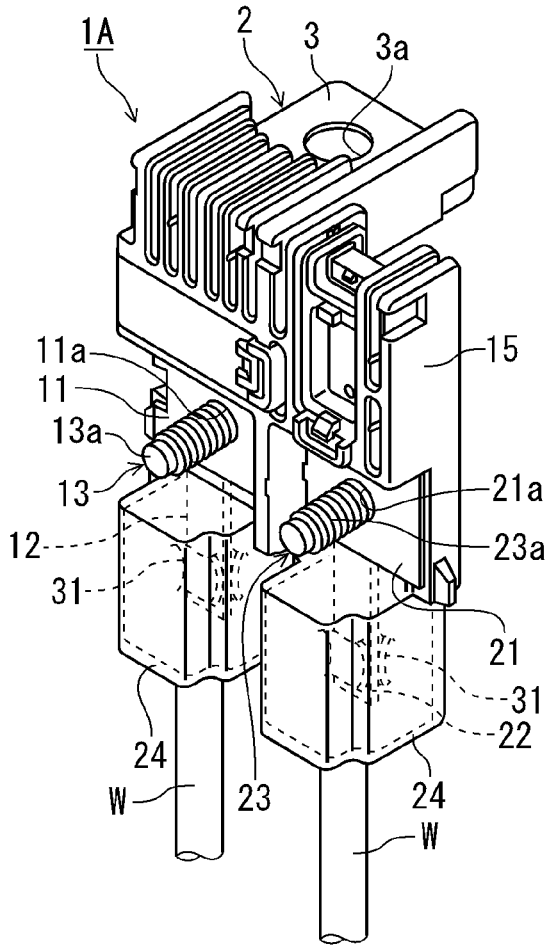
FIG. 4 is a perspective view of the fuse unit to which the other terminal is connected by a connector.

In the fuse unit 1A made in the above procedure, in a case of each of the other terminals 30 for bolt connection, each of the other terminals 30 is connected to the bolt connection portions 11, 21 by bolting as shown in FIG. 3. Each of the other terminals 30 is set transversely and is bolted. An electric wire W connected to the other terminal 30 is led out in a transverse direction. Also, in the case of each of the other terminals 31 for connector connection, each of the other terminals 31 is connected to the connector connection portions 12, 22 by connector connection as shown in FIG. 4. An electric wire W connected to the other terminal 31 is led out in a downward direction.

As described above, the bolt connection portions 11, 21 connected by the bolt and the connector connection portions 12, 22 connected by the connector are included every terminal connection parts 10, 20. Therefore, the fuse unit can accommodate to both of bolting connection and the connector connection. Further, one type of fuse unit 1A will suffice, so that the total cost can be reduced.

The busbar 2 provided with the bolt connection portions 11, 21 and the connector connection portions 12, 22 and the insulating resin part 15 arranged in the outer periphery of the busbar 2 are included, the bolt connection portions 11, 21 are provided with the bolt insertion holes 11*a*, 21*a*, the stud bolts 13, 23 inserted into the bolt insertion holes 11*a*, 21*a* are fixed by the insulating resin part 15, the connector connection portions 12, 22 are the tab terminals formed by a part of the busbar 2, and the connector housing parts 24 are formed in outer peripheries of the tab terminals by the insulating resin part 15. Therefore, the fuse unit 1A capable of accommodating to both of the bolting connection and the connector connection can be made by a metallic mold of one type of busbar 2 and a metallic mold of one type of insert molding, so that a cost of the metallic mold is reduced or manufacturing work by the metallic mold is simplified.

The screw parts 13*a*, 23*a* of the stud bolts 13, 23 project to the same side as the side to which the connector housing parts 24 projects. Therefore, each of the other terminals 30 is set in a direction in which each of the other terminals 30 does not interfere with the connector housing part 24, that is, in the transverse direction, and each of the other terminals 30 is bolted.

Figure 5:
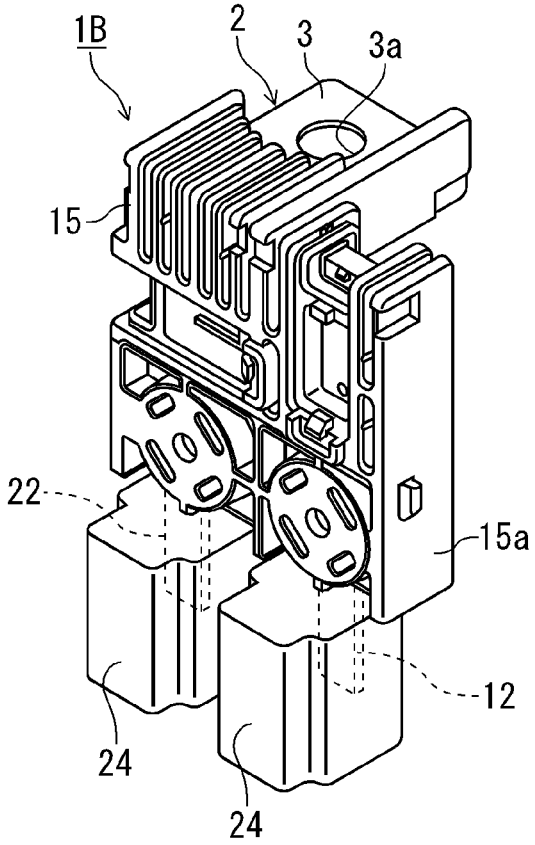
FIG. 5 is a perspective view from the front side of a fuse unit according to a second embodiment of the present invention.
Figure 6:
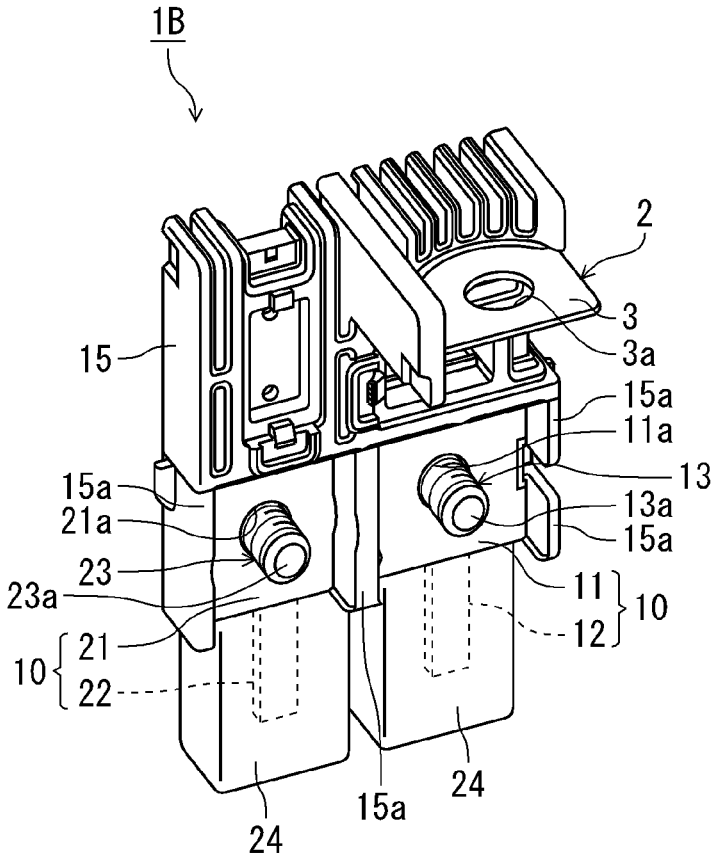
FIG. 6 is a perspective view from the back side of the fuse unit.
Figure 7:
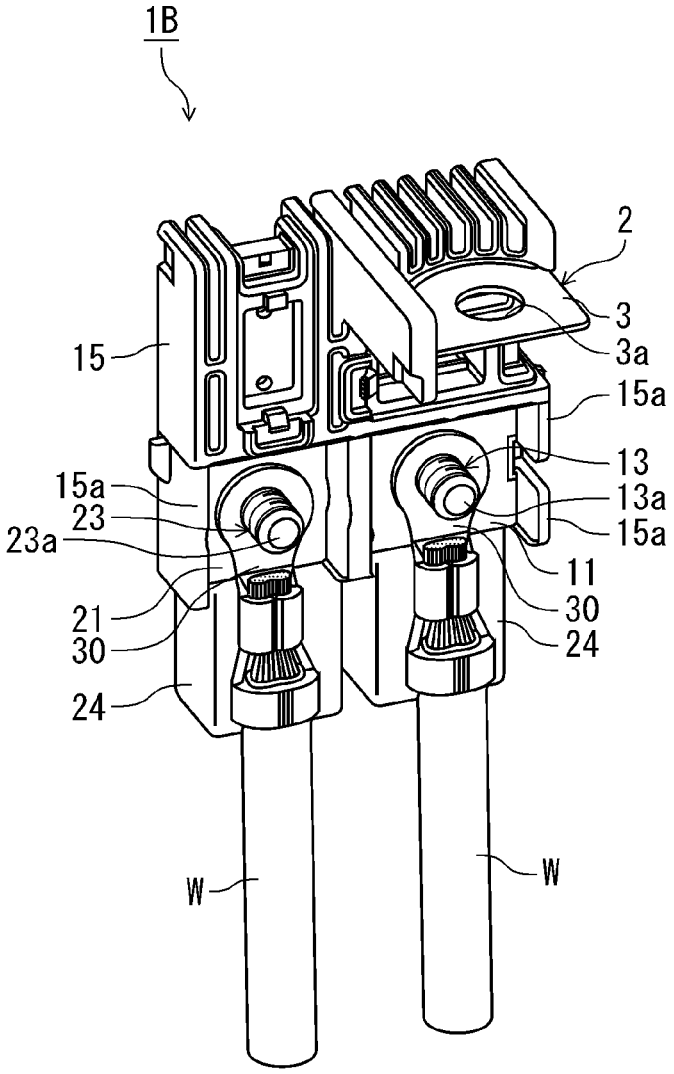
FIG. 7 is a perspective view of the fuse unit to which the other terminal is connected by bolting.

FIGS. 5 to 7 show a second embodiment of the invention.

A fuse unit 1B differs from that of the first embodiment in that a direction of installation of stud bolts 13, 23 is set in a reverse direction in the front and back as shown in FIGS. 5 and 6. That is, each of the screw parts 13*a*, 23*a* of the stud bolts 13, 23 projects to a side opposite to a side to which a connector housing part 24 projects. That is, each of the screw parts 13*a*, 23*a* projects to the side to which the connector housing part 24 does not project.

Since the other configurations are similar to those of the first embodiment, the description is omitted. The configurations are clarified by assigning the same numerals as the first embodiment to the same configuration places of the drawings.

Also in this second embodiment, bolt connection portions 11, 21 connected by bolts and connector connection portions 12, 22 connected by connectors are included every terminal connection parts 10, 20 like the first embodiment. Therefore, the fuse unit can accommodate to both of bolting connection and connector connection. Further, one type of fuse unit 1B will suffice, so that the total cost can be reduced.

The screw parts 13*a*, 23*a* of the stud bolts 13, 23 project to the side opposite to the side to which the connector housing parts 24 project. Therefore, each of the other terminals 30 is set longitudinally and is bolted as shown in FIG. 7. An electric wire W connected to the other terminal 30 is led out in the downward direction. Consequently, the electric wire W can be led out downwardly in a manner similar to the other terminal (not shown) connected by a connector even when the other terminal of a special form including an L shape is not used as the other terminal 30.

In the second embodiment thus, the electric wire W can be led out in the same direction even for bolt connection and connector connection, so that cabling space of the electric wire W can be reduced.

In this second embodiment, the bolt connection portions 11, 21 are constructed so that each of the other terminals 30 can be set only longitudinally by a partition wall 15*a* of an insulating resin part 15, but a direction of the partition wall 15*a* can be changed properly and the other terminal 30 can be set in a desired direction. Also, when it is unnecessary to install the partition wall 15*a*, a direction of installation of each of the other terminals 30 can be set freely and a lead-out direction of the electric wire W can be selected freely.

Figure 8:
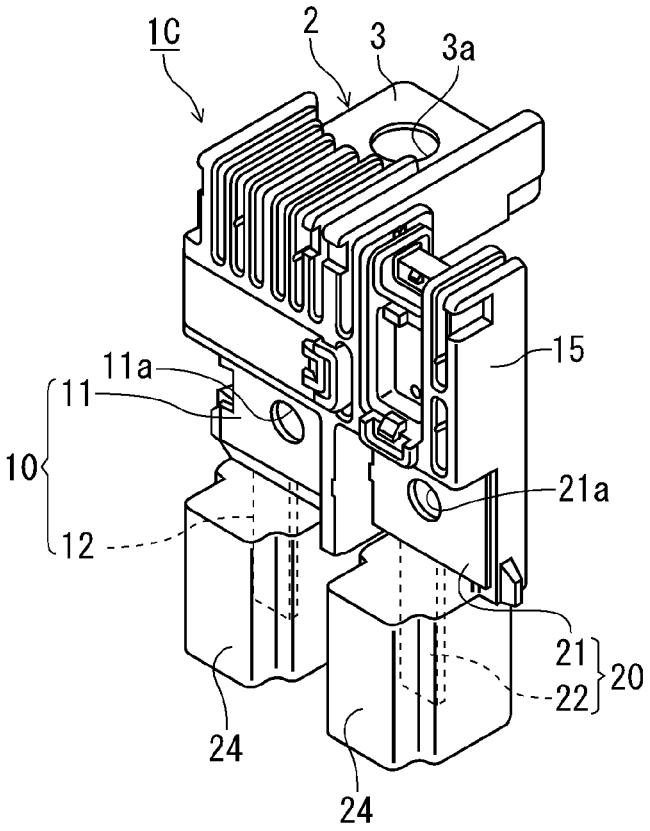
FIG. 8 is a perspective view of a fuse unit according to a third embodiment of the present invention.
Figure 9:
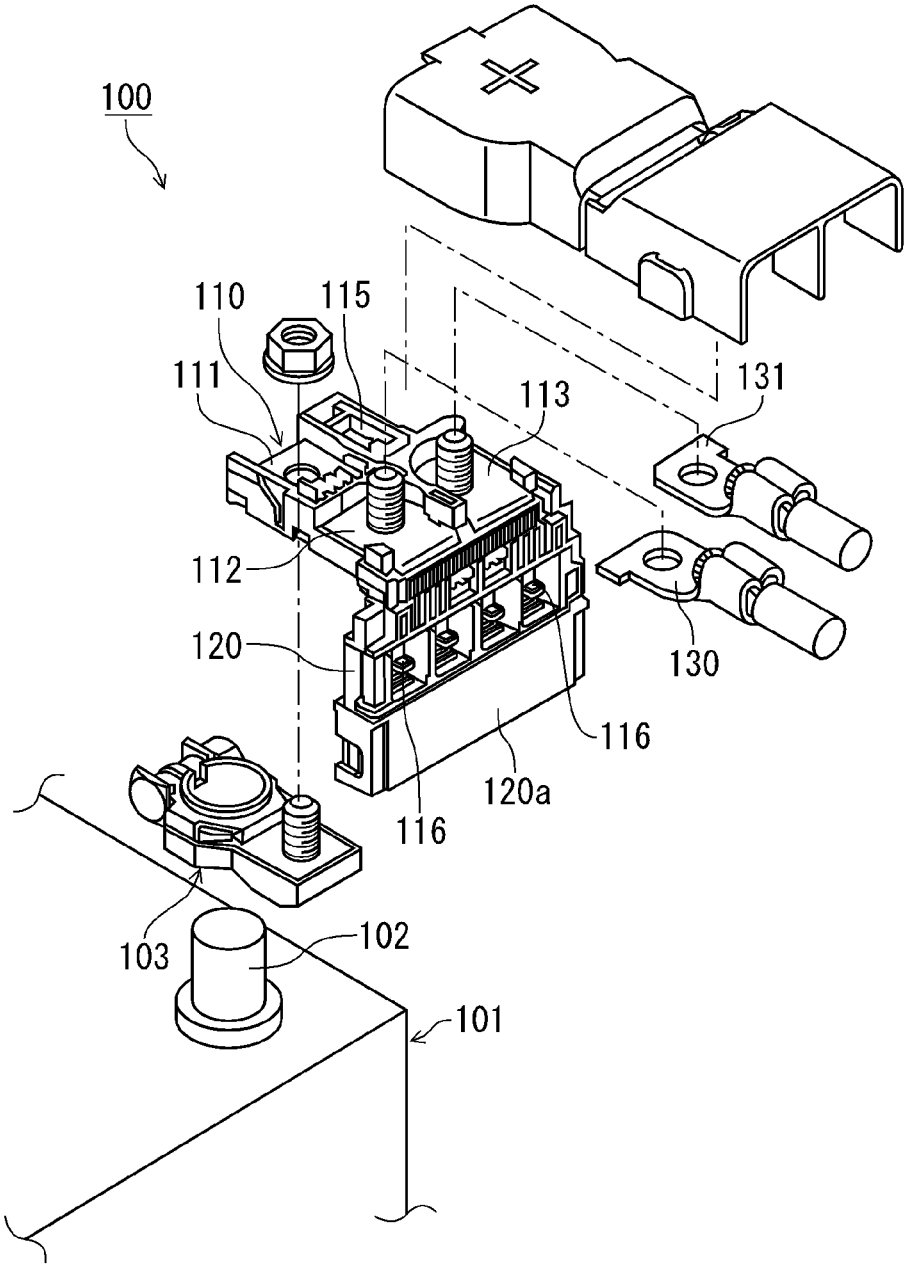
FIG. 9 Related Art
FIG. 9 is an exploded perspective view showing a state of directly mounting a fuse unit of a conventional fuse unit on a battery.
Figure 10:
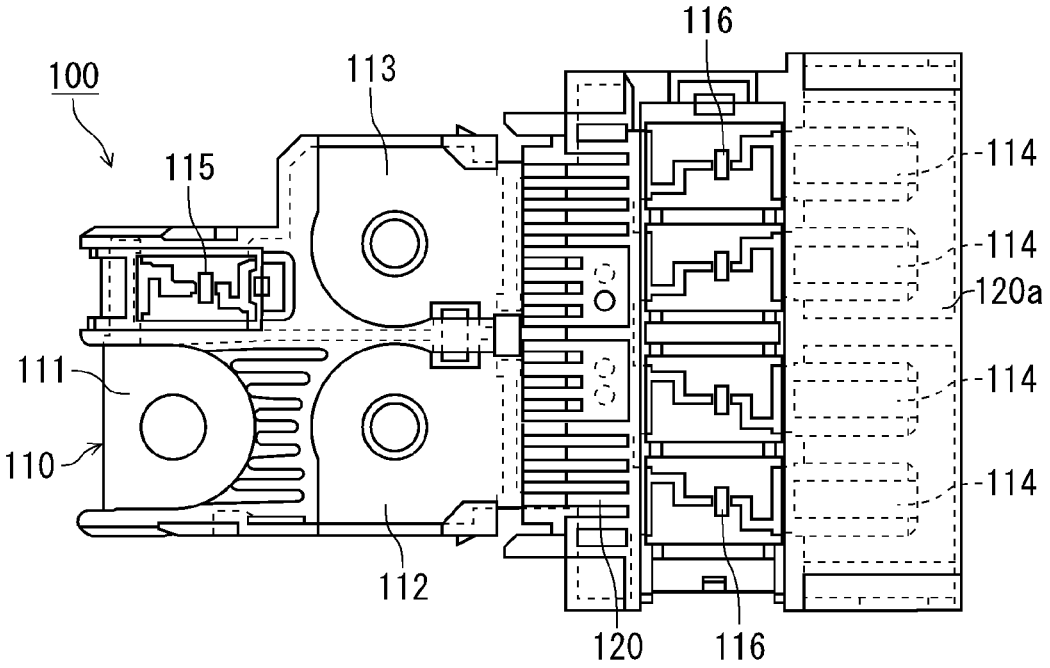
FIG. 10 Related Art
FIG. 10 is a plan view before folding processing of the conventional fuse unit.

FIG. 8 shows a third embodiment of the invention. A fuse unit 1C of the third embodiment differs from that of the first embodiment in that stud bolts 13, 23 are not attached to bolt connection portions 11, 21 in FIG. 8. That is, in the case of insert molding, the insert molding is performed without attaching the stud bolts 13, 23 to bolt insertion holes 11*a*, 21*a* of the bolt connection portions 11, 21.

Since the other configurations are similar to those of the first embodiment, the description of the same configuration places is omitted. The configurations are clarified by assigning the same numerals to the same configurations of the drawings.

A user who makes connection by a connector does not require the bolt connection portions 11, 21. Therefore, a component cost and assembly work of stud bolts (not shown) can be reduced by using the fuse unit 1C of the third embodiment.

Also, when the connection parts 11, 21 for bolt are used, a projecting direction of a screw part of the stud bolt (not shown) can be selected freely by being set in the front side or the back side. Therefore, when the other terminal to be bolted is set transversely and an electric wire is led out in the transverse direction, the screw part of the stud bolt is projected to the front side. When the other terminal to be bolted is set, for example, longitudinally rather than transversely and the electric wire is led out, the screw part of the stud bolt is projected to the back side.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the inventions as defined by the appended claims.

The present application is based on Japanese Patent Application No. 2010-087700 filed on Apr. 6, 2010 and Japanese Patent Application No. 2011-036989 filed on Feb. 23, 2011, the contents of which are incorporated herein by way of reference.

INDUSTRIAL APPLICABILITY

The present invention is extremely useful to provide a fuse unit capable of accommodating to both of the bolting connection and the connector connection, so that one type of fuse unit will suffice and the total cost can be reduced.

REFERENCE SIGNS LIST

1A to 1C fuse unit
2 busbar
3 power-feeding connection part
10, 20 terminal connection part
11, 21 bolt connection portion
11*a*, 21*a* bolt insertion hole
12, 22 connector connection part
13, 23 stud bolt
13*a*, 23*a* screw part
15 insulating resin part
24 connector housing part
30 other terminal for bolt connection
31 other terminal for connector connection

The invention claimed is:

1. A fuse unit, comprising:
a first connection part to which power is fed; and
a second connection part configured to be substantially perpendicular extended from the first connection part and being connected with a mating terminal, the second connection part including:
a bolt connection portion to which the mating terminal is connected by a bolt; and
a connector connection portion to which the mating terminal is connected by a connector;
wherein the bolt connection portion is formed with a bolt insertion hole,
the connector connection portion is a tab terminal, and
the bolt insertion hole is formed in the bolt connection portion such that an axis of a stud bolt to be inserted into the bolt insertion hole is perpendicular to a plane of a substantially planar part of the tab terminal.

2. The fuse unit according to claim 1, wherein
the bolt connection portion and the connector connection portion are provided in a busbar,
an insulating resin part is provided around the busbar,
a stud bolt which is inserted into the bolt insertion hole is fixed by the insulating resin part,
the connector connection portion is a tab terminal formed by a part of the busbar, and
a connector housing is formed at periphery of the tab terminal by the insulating resin part.

3. The fuse unit according to claim 2, wherein
a screw of the stud bolt projects at a side which the connector housing projects with respect to the connector connection portion.

4. The fuse unit according to claim 2, wherein
a screw of the stud bolt projects at a side opposite to a side which the connector housing projects with respect to the connector connection portion.

5. The fuse unit according to claim 1, wherein
the bolt connection portion and the connector connection portion are provided in a busbar,
an insulating resin part is provided around the busbar,
the connector connection portion is a tab terminal formed by a part of the busbar, and
a connector housing is formed at periphery of the tab terminal by the insulating resin part.

6. The fuse unit according to claim 1, wherein
the bolt insertion hole is formed in the bolt connection portion such that the axis of the stud bolt to be inserted into the bolt insertion hole is perpendicular to an axis of a bolt to be inserted into a bolt insertion hole formed in the first connection part.

* * * * *